US011330949B2

(12) United States Patent
Brown et al.

(10) Patent No.: US 11,330,949 B2
(45) Date of Patent: May 17, 2022

(54) SURFACE CLEANING DEVICE WITH COMPACT STORAGE CONFIGURATION

(71) Applicant: SHARKNINJA OPERATING LLC, Needham, MA (US)

(72) Inventors: Andre D. Brown, Natick, MA (US); Daniel J. Innes, West Roxbury, MA (US)

(73) Assignee: SharkNinja Operating LLC, Needham, MA (US)

( * ) Notice: Subject to any disclaimer, the term of this patent is extended or adjusted under 35 U.S.C. 154(b) by 215 days.

(21) Appl. No.: 16/621,489

(22) PCT Filed: Jun. 12, 2018

(86) PCT No.: PCT/US2018/037106
§ 371 (c)(1),
(2) Date: Dec. 11, 2019

(87) PCT Pub. No.: WO2018/231831
PCT Pub. Date: Dec. 20, 2018

(65) Prior Publication Data

US 2020/0205631 A1 Jul. 2, 2020

Related U.S. Application Data

(60) Provisional application No. 62/518,287, filed on Jun. 12, 2017.

(51) Int. Cl.
*A47L 9/32* (2006.01)
*A47L 5/28* (2006.01)
(Continued)

(52) U.S. Cl.
CPC ..... *A47L 9/325* (2013.01); *A47L 5/28* (2013.01); *A47L 9/0063* (2013.01); *A47L 9/2873* (2013.01)

(58) Field of Classification Search
CPC ..... A47L 5/28; A47L 9/0009; A47L 9/0063; A47L 9/2873; A47L 9/325
See application file for complete search history.

(56) References Cited

U.S. PATENT DOCUMENTS 3,758,914 A * 9/1973 Nupp ..... A47L 5/24 15/329
4,662,026 A * 5/1987 Sumerau ..... A47L 9/32 15/144.4
(Continued)

FOREIGN PATENT DOCUMENTS

DE 202007014621 U1 2/2008
DE 102018127090 A1 * 4/2020 ..... A47L 5/28
(Continued)

OTHER PUBLICATIONS

PCT Search Report and Written Opinion dated Nov. 9, 2018, received in PCT Appliation No. PCT/US18/37106, 18 pgs.
(Continued)

*Primary Examiner* — Marc Carlson
(74) *Attorney, Agent, or Firm* — Grossman Tucker Perreault & Pfleger, PLLC

(57) ABSTRACT

A cordless surface cleaning apparatus is disclosed that includes a compact storage configuration to allow the surface cleaning apparatus to have a small, compact footprint relative to an in-use configuration. The storage configuration therefore allows for storage in locations otherwise unsuitable for other surface cleaning apparatuses, e.g., upright vacuum cleaners, and so on. For instance, a surface cleaning apparatus configured in accordance with aspects disclosed herein may have a footprint with an overall width that allows the same to be hidden between an open door and an adjacent wall or other similarly narrow space such as a small closet. Moreover, the surface cleaning apparatus may include an aesthetically pleasing, minimalist design in addition to a
(Continued)

small footprint, which allows the surface cleaning apparatus to be placed at a conspicuous location, such as against a wall, without becoming obtrusive or otherwise disruptive to the surrounding environment.

15 Claims, 10 Drawing Sheets

(51) Int. Cl.
*A47L 9/00* (2006.01)
*A47L 9/28* (2006.01)

(56) References Cited

U.S. PATENT DOCUMENTS

| | | | | |
|---|---|---|---|---|
| 4,670,701 | A | 6/1987 | Sako et al. | |
| 4,956,892 | A | 9/1990 | Fawkes | |
| 6,768,073 | B1 * | 7/2004 | Tondra | A47L 9/2842 200/331 |
| 6,779,229 | B2 * | 8/2004 | Lee | A47L 9/00 15/329 |
| 6,941,615 | B2 * | 9/2005 | Shanor | A47L 9/325 15/339 |
| 7,281,298 | B2 * | 10/2007 | Joung | A47L 9/325 15/410 |
| 7,584,522 | B1 * | 9/2009 | Weeter | A47L 5/30 15/350 |
| 8,813,308 | B2 * | 8/2014 | Xue | B65D 35/36 15/411 |
| 9,125,538 | B2 * | 9/2015 | Paliobeis | A47L 9/325 |
| 10,285,548 | B2 * | 5/2019 | Gu | A47L 9/02 |
| 10,966,581 | B2 * | 4/2021 | Innes | A47L 9/242 |
| 2005/0125944 | A1 * | 6/2005 | Ji | A47L 9/325 15/410 |
| 2005/0273972 | A1 * | 12/2005 | Park | A47L 9/0054 15/414 |
| 2006/0156509 | A1 * | 7/2006 | Luebbering | A47L 9/1472 15/410 |
| 2008/0030032 | A1 * | 2/2008 | Gill | A47L 5/28 294/1.3 |
| 2009/0056059 | A1 * | 3/2009 | Mersmann | A47L 9/242 15/347 |
| 2009/0265879 | A1 | 10/2009 | Scott | |
| 2010/0229315 | A1 * | 9/2010 | Rosenzweig | B25G 3/38 15/144.1 |
| 2010/0229336 | A1 * | 9/2010 | Conrad | A47L 5/32 15/415.1 |
| 2011/0113589 | A1 * | 5/2011 | Geither | A47L 9/325 15/347 |
| 2011/0219581 | A1 | 9/2011 | Vines et al. | |
| 2011/0308038 | A1 * | 12/2011 | Rowntree | A47L 5/24 15/347 |
| 2013/0207615 | A1 | 2/2013 | Sunderland | |
| 2014/0026353 | A1 * | 1/2014 | Paliobeis | A47L 9/325 15/347 |
| 2015/0374184 | A1 | 12/2015 | Gu et al. | |
| 2017/0202413 | A1 * | 7/2017 | Tan | A47L 5/14 |
| 2018/0055311 | A1 * | 3/2018 | Conrad | A47L 9/1625 |
| 2020/0187738 | A1 * | 6/2020 | Conrad | A47L 5/36 |

FOREIGN PATENT DOCUMENTS

| | | | | |
|---|---|---|---|---|
| EP | 1525837 | A1 * | 4/2005 | A47L 5/32 |
| EP | 2033559 | A2 * | 3/2009 | A47L 9/102 |
| EP | 2873358 | A1 * | 5/2015 | A47L 9/0018 |
| JP | 2000354561 | A | 12/2000 | |
| JP | 2001218709 | A | 8/2001 | |
| WO | 2005034706 | A2 | 4/2005 | |
| WO | WO-2005032735 | A2 * | 4/2005 | A47L 11/4061 |
| WO | WO-2005034706 | A2 * | 4/2005 | A47L 7/0042 |
| WO | 2014091392 | A1 | 6/2014 | |
| WO | WO-2014091392 | A1 * | 6/2014 | A47L 5/30 |

OTHER PUBLICATIONS

Japanese Office Action with English translation dated Feb. 25, 2021, received in Japanese Patent Application No. 2019-568238, 13 pages.
Chinese Office Action with English translation dated Nov. 16, 2020, received in Chinese Patent Application No. 201880044330.7, 12 pages.
European Search Report dated Feb. 15, 2021, received in European Patent Application No. 18817177.1, 3 pages.
Canadian Office Action dated Feb. 8, 2021, received in Canadian Patent Application No. 3,067,214, 4 pages.

* cited by examiner

SURFACE CLEANING DEVICE WITH COMPACT STORAGE CONFIGURATION

TECHNICAL FIELD

The present disclosure relates to surface cleaning devices, and more particularly, a surface cleaning device with a compact storage configuration, and an optional docking charger for convenient storage and recharging purposes.

RELATED APPLICATIONS

The present non-provisional application claims the benefit of U.S. Provisional patent application Ser. No. 62/518,287 filed on Jun. 12, 2017, the entire content of which is hereby incorporated by reference.

BACKGROUND INFORMATION

Powered devices, such as vacuum cleaners, have multiple components that each receive electrical power from one or more power sources (e.g., one or more batteries or electrical mains). For example, a vacuum cleaner may include a suction motor to generate a vacuum within a cleaning head. The generated vacuum collects debris from a surface to be cleaned and deposits the debris, for example, in a debris collector. The vacuum may also include a motor to rotate a brush roll within the cleaning head. The rotation of the brush roll agitates debris that has adhered to the surface to be cleaned such that the generated vacuum is capable of removing the debris from the surface. In addition to electrical components for cleaning, the vacuum cleaner may include one or more light sources to illuminate an area to be cleaned.

Vacuum cleaners generally occupy a relatively large amount of space in a closet or other storage location. For instance, up-right vacuums tend to be left an in-use, up-right position when stored away for future use. To this end, storage of a vacuum cleaner requires a space that can accommodate the overall height and width of the vacuum. This often relegates vacuums to storage locations in unseen places such as a closet, garage, or other out-of-the-way place. Such locations may be some distance from rooms and other locations that may require periodic cleaning, which may result in less cleaning of those locations as hauling a vacuum to and from storage may be impractical or otherwise inconvenient. Moreover, some environments such as apartments, tiny homes, and other space-constrained environments, may not have a suitable location to store a vacuum cleaner, and thus, may be without the assistance and effectiveness of a vacuum cleaner.

BRIEF DESCRIPTION OF THE DRAWINGS

These and other features and advantages will be better understood by reading the following detailed description, taken together with the drawings, wherein.

DETAILED DESCRIPTION

Figure 1:
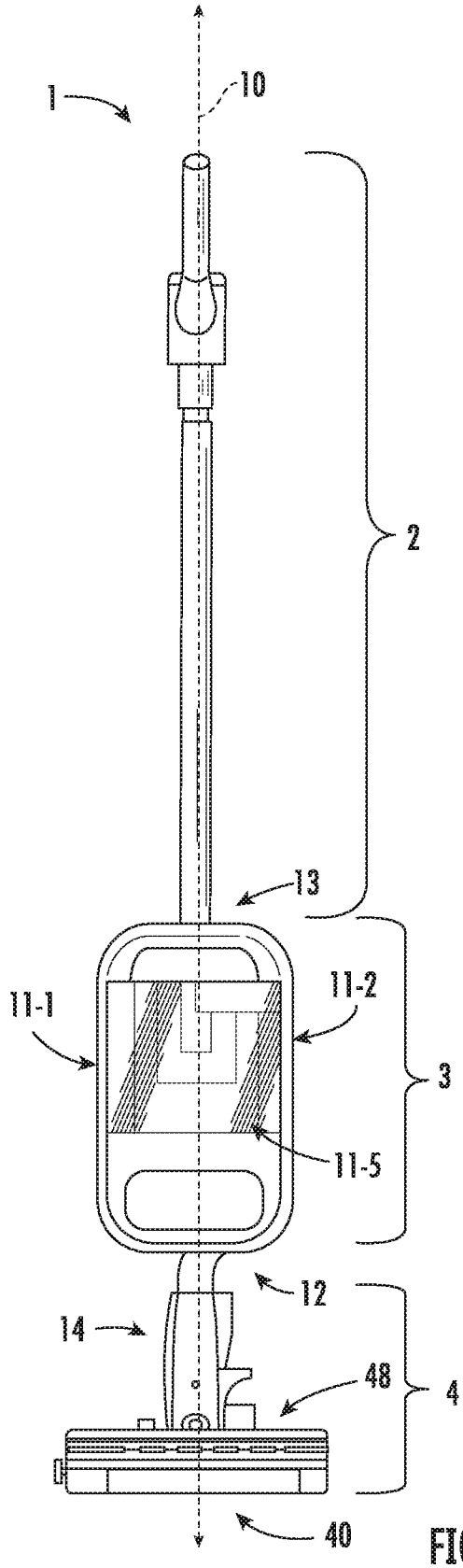
FIGS. 1-3 show perspective views of an example of a surface cleaning apparatus, in accordance with embodiments of the present disclosure.

As discussed above, many environments do not permit the easy storage of vacuum cleaners and other surface cleaning devices. While cordless surface cleaners have led to smaller footprints and less complicated storage procedures (e.g., by eliminating the winding up of an associated a power cord), many spaces still lack a suitable space, e.g., a closet or other out-of-the-way place, to store such devices.

Thus, in accordance with an embodiment of the present disclosure, a surface cleaning apparatus is disclosed that includes a compact storage configuration to allow the surface cleaning apparatus to have a small, compact footprint relative to an in-use configuration. The surface cleaning apparatus may be cordless, e.g., utilize one or more batteries, although this disclosure is equally applicable to corded cleaning apparatuses. The storage configuration therefore allows for storage in locations otherwise unsuitable for other surface cleaning apparatuses, e.g., upright vacuum cleaners, and so on. For instance, a surface cleaning apparatus configured in accordance with aspects disclosed herein may have a footprint with an overall width that allows the same to be hidden between an open door and an adjacent wall or other similarly narrow space such as a small closet. Moreover, the surface cleaning apparatus may include an aesthetically pleasing, minimalist design in addition to a small footprint, which allows the surface cleaning apparatus to be placed at a conspicuous location, such as against a wall, without becoming obtrusive or otherwise disruptive to the surrounding environment.

In more detail, a surface cleaning apparatus disclosed herein includes a handle member rotatably coupled to a housing portion. The handle member includes a rotational axis offset from a center line of the housing. Thus, the handle member may rotate about the housing and transition from an in-use position, e.g., extending from the housing, to a storage position. The offset of the rotational axis relative to the center line of the housing may then allow the handle to rotate about 180 degrees and travel to a storage location, wherein the storage location includes the handle member extending in parallel with an adjacent sidewall of the housing. In some cases, the handle member includes a telescoping arrangement to extend/retract the handle member when transitioning from in-use to storage configurations, and vice-versa.

In addition, a cleaning head coupled to the housing may also be configured to rotate about the housing from a horizontal in-use position to engage a surface to be cleaned to a vertical storage position. Accordingly, the surface cleaning apparatus may include a storage configuration whereby the handle member is folded to one side of the housing and the cleaning head is locked in a vertical configuration. Thus, the overall depth of the surface cleaning apparatus along its entire length may be relatively small and compact, e.g., compared to an in-use configuration of the surface cleaning apparatus. Likewise, the overall height of the surface cleaning apparatus in the storage configuration may be equal to or less than half the overall height of the surface cleaning apparatus when in the in-use configuration.

In an embodiment of the present disclosure, a surface cleaning apparatus transitions between an in-use configuration and a storage configuration automatically based on a button press or other user-input. As used herein the term automatically generally refers to performing a sequence of actions without a user's manual intervention at each step. In this embodiment, the surface cleaning apparatus may automatically retract a handle member based at least in part on a telescoping arrangement in the handle member. While retracting the handle member, or after the handle member is fully retracted, the surface cleaning apparatus may automatically rotate the handle member to the storage position. In addition, the cleaning head of the surface cleaning apparatus may automatically rotate and transition from the horizontal configuration to the vertical configuration, which is to say from an in-use position to a storage position, respectively. The sequence may then end by automatically locking the handle member and/or cleaning head in their respective storage locations.

In another embodiment of the present disclosure a charging dock is disclosed. The charging dock may be configured to be wall-mounted or floor-mounted. In either case, a charging dock consistent with an embodiment of the present disclosure may physically and electrically couple to a surface cleaning apparatus for battery recharging and/or storage purposes. In some cases, the act of coupling the surface cleaning apparatus to a charging dock may cause the surface cleaning apparatus to automatically transition from an in-use configuration to a storage configuration, as discussed above.

As the surface cleaning apparatus may be relatively light weight, e.g., 4 pounds or less in some instances, the charging dock may be coupled to a wall or other surface using suction cups (or other such re-sealable device such as hook and loop systems), an adhesive, tape, or other suitable temporary device. In many locations, e.g., offices, apartments, and so on, permanent alterations to a wall may be prohibited. The charging dock may securely hold the surface cleaning apparatus securely in place without the use of a permanent attachment device, such as screws, which may advantageously avoid damage/alteration to a wall.

As used herein, the terms "substantially" and "about" when used in connection with an amount or range mean plus or minus 5% of the stated amount or the endpoints of the stated range, unless otherwise specified herein.

Each of the embodiments disclosed herein may be used in combination with other embodiments. Stated differently, although embodiments may include different shapes and configurations of a surface cleaning device, features of each embodiment may be combined unless otherwise noted.

Figure 2:
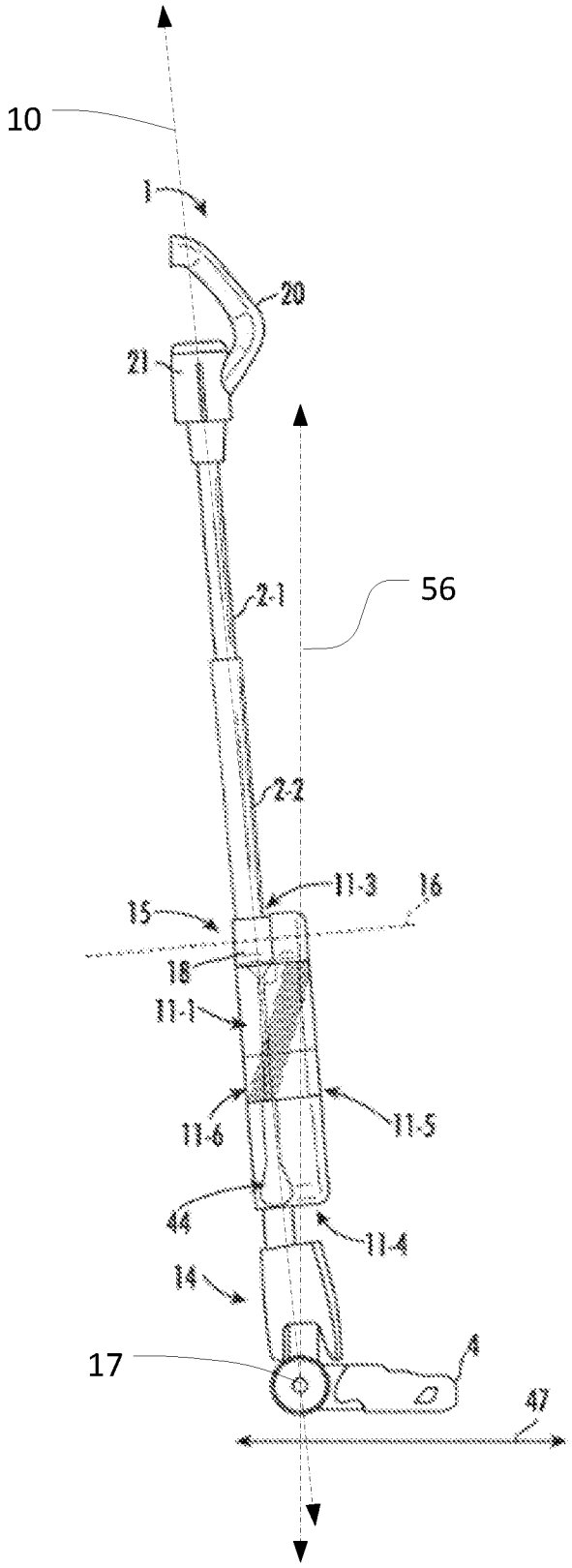
Figure 3:
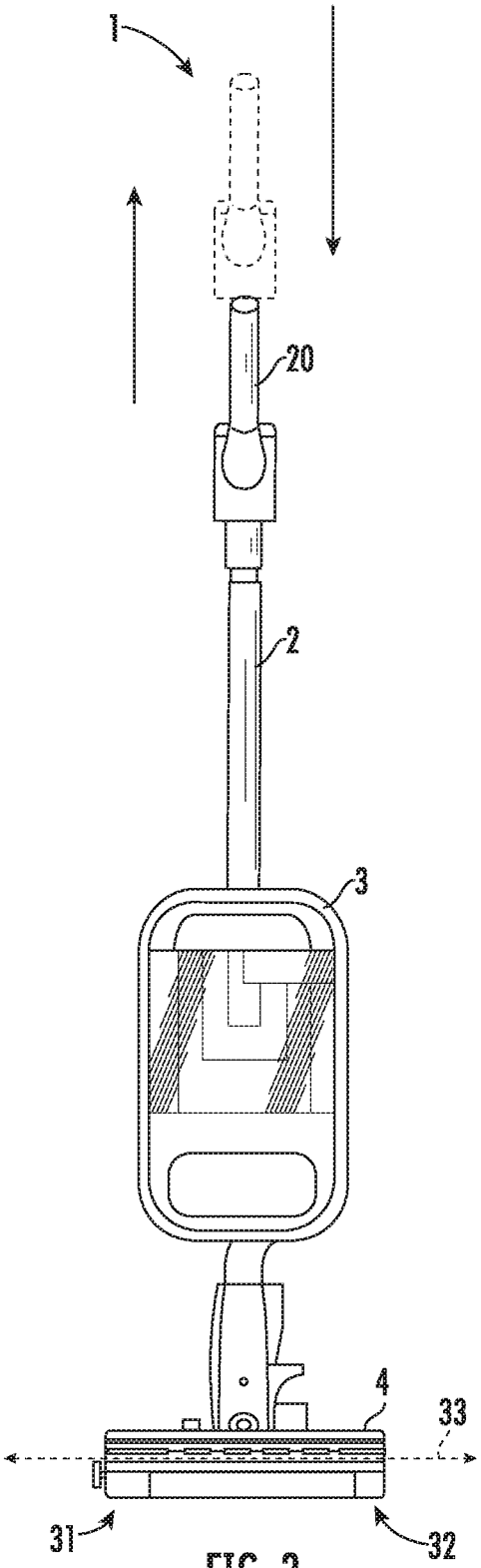

Turning to the Figures, FIGS. 1-3 show an example embodiment of a surface cleaning apparatus 1 in accordance with an embodiment of the present disclosure. As shown, the surface cleaning apparatus 1 includes a handle member 2, a housing 3, and a cleaning head 4. The handle member 2 may also be referred to as a handle portion, or simply a handle. Likewise, the housing 3 may also be referred to as an upright portion or a support structure. The cleaning head 4 may also be referred to as a nozzle. Although aspects and examples discussed herein specifically reference the surface cleaning apparatus 1 being a vacuum cleaner, this disclosure is not necessarily limited in this regard.

In more detail, the housing 3 is defined by sidewalls 11-1 and 11-2 that extend from a cleaning head end 12 to a handle end 13 along longitudinal axis 10. Walls 11-5 and 11-6 may adjoin the sidewalls 11-1 and 11-2. The housing 3 may also include sidewalls 11-3 and 11-4 that define the handle end 13 and the cleaning head end 12, respectively. The housing 3 is shown has having a generally rectangular shape, but this disclosure should not be construed as limited in this regard. For example, the housing 3 may have other shapes and configurations such as a generally cylindrical shape.

In any event, the housing 3 may be formed from multiple parts and may include a removable dirt/debris collection portion (or dust cup) to allow for easy cleaning and maintenance.

The handle end 13 may provide a handle coupling section 15 to allow the handle member 2 to movably couple to the housing 3. Note that the position of the handle coupling section 15 may not necessarily be at an end of the housing 3, such as shown, and may be disposed at other locations, e.g., disposed along sidewall 11-16.

The handle coupling section 15 may comprise a rotatable member 18 configured to allow the handle member 2 to rotate about the housing 3 via rotational axis 16, which may also be referred to as handle member rotational axis 16. The rotational axis 16 may be substantially perpendicular to longitudinal axis 10 of the surface cleaning apparatus 1. In an embodiment, the handle coupling section 15 thus may provide a plurality of positions that allow the handle member 2 rotate up to about 180 degrees to transition the handle member 2 between an in-use position (or configuration) and a storage position (or configuration), as discussed in greater detail below. When in the storage position, the handle member 2 may extend toward the cleaning head and may be in parallel with a sidewall, e.g., sidewall 11-1 of the housing 3, which is shown more clearly in FIGS. 5 and 6.

The handle coupling section 15 may also be removably coupled to the handle member 2. For example, the handle coupling section 15 may provide a button, pin, screw, peg, or other mechanism to allow the handle member 2 to be decoupled for de-clogging or replacement purposes, for example.

The cleaning head end 12 may provide a cleaning head coupling section 14 to allow the cleaning head 4 to movably couple to the housing 3. Note that the position of the cleaning head coupling section 14 may not necessarily be at an end of the housing 3, such as shown, and other locations are within the scope of this disclosure. The cleaning head coupling section 14 may allow for the housing to pivot/swivel (e.g., via first and second rotation axis 17 and 56 discussed below) and may form, in a general sense, a joint that allows for articulation of the housing 3 (forward, backward, left, right) relative to the cleaning head 4, which may allow for easy steering of the surface cleaning apparatus 1 around obstacles during use.

Figure 5:
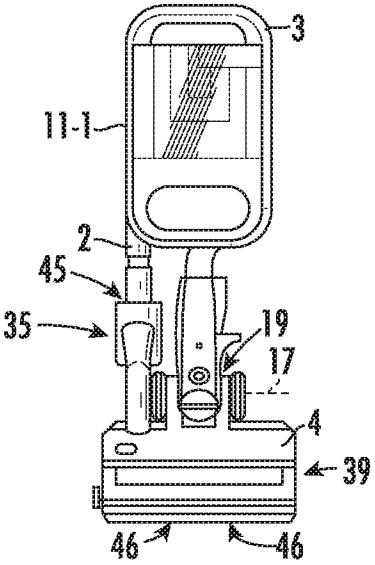
Figure 10:
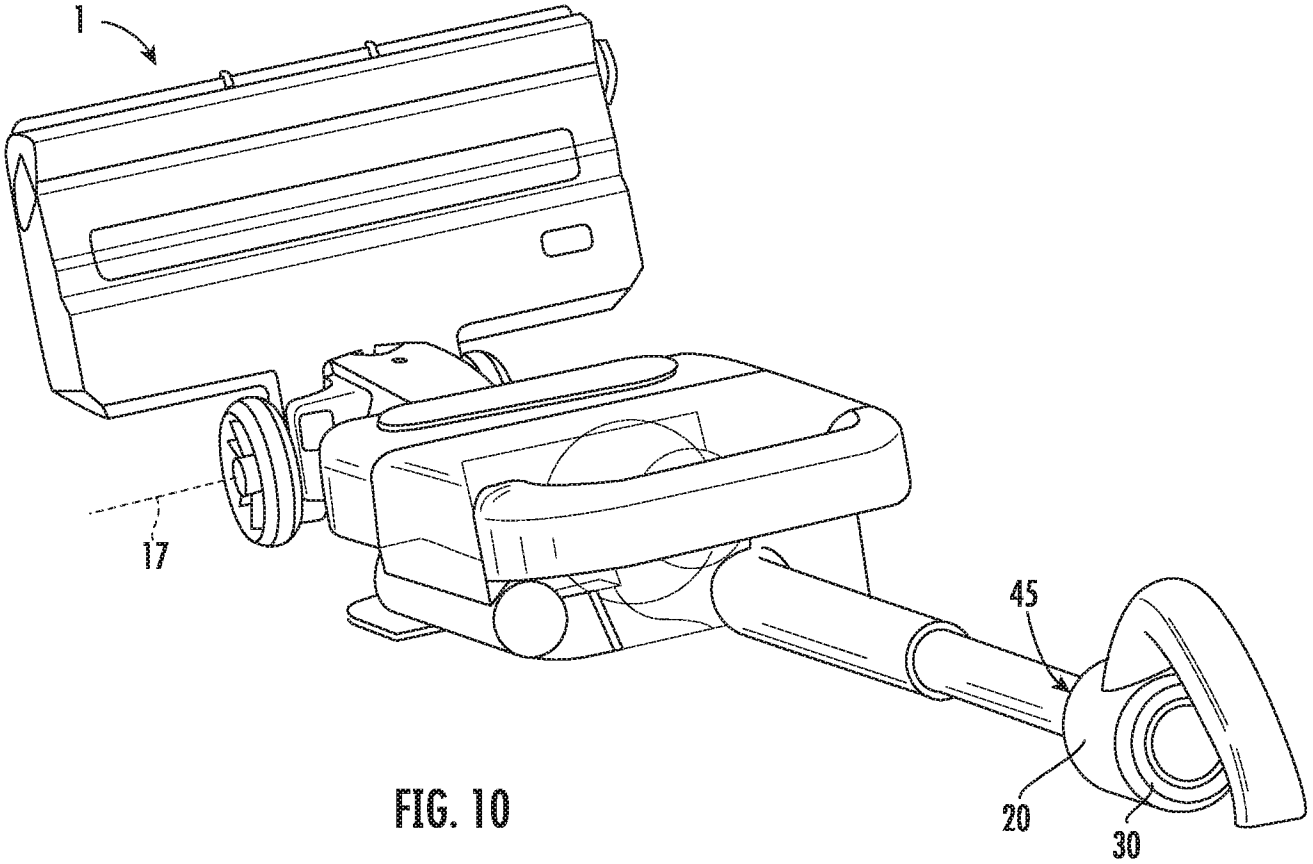
FIG. 10 shows a perspective view of an example of a surface cleaning apparatus having a battery charge indicator disposed on handle member, in accordance with embodiments of the present disclosure.

In addition, the cleaning head coupling section 14 may include a rotatable member 19 to allow the cleaning head 4 to rotate about the housing 3 via rotational axis 17, which is shown more clearly in FIGS. 5 and 10. The rotational axis 17 may also be referred to as a first cleaning head rotational axis 17. The rotatable member 19 may also include a second cleaning head rotational axis 56 (FIG. 2) to allow for additional movement relative to the housing 3, e.g., swiveling, to allow the surface cleaning apparatus to be easily steered when in use. The second cleaning head rotation axis 56 may be substantially perpendicular to the first cleaning head rotation axis 17. The second cleaning head rotation axis 56 may be at an angle of about 45 degrees relative to a longitudinal axis 10 of the housing. As shown, the handle member rotational axis 16 is substantially perpendicular relative to the first cleaning head rotational axis 17.

In an embodiment, the cleaning head coupling section 14 may provide a plurality of positions to allow the cleaning head 4 to rotate from a horizontal configuration (FIG. 2), which may also be referred to as an in-use position (or orientation), to a vertical configuration (FIG. 5), which also may also be referred to as a storage position (or orientation), as will be discussed in greater detail below.

In an embodiment, the handle member 2 includes a proximal end (or first end) adjacent the handle coupling section 15 and a distal end (or second end). The distal end may include a grip portion 20 (or hand grip portion 20). The grip portion 20 may include a generally arcuate (or curved) shape, such as shown, although other shapes are within the scope of this disclosure. The grip portion 20 may include one or more controls (not shown) for switching the surface cleaning apparatus 1 ON/OFF, to cause the surface cleaning apparatus to transition to/from a storage configuration, or to otherwise adjust operation (e.g., adjust suction power, disable the rotation of rollers within the cleaning head 4, and so on).

In an embodiment, the grip portion 20 may define an optional battery housing 21. The battery housing 21 may include a cylindrical shape, although this disclosure is not limited in this regard. In some cases, a longitudinal axis of the battery housing 21 extends in parallel with a longitudinal axis of the handle member 2. In some cases, the longitudinal center line of the battery housing 21 extends coaxially with the longitudinal center line of the handle member 2.

Figure 8:
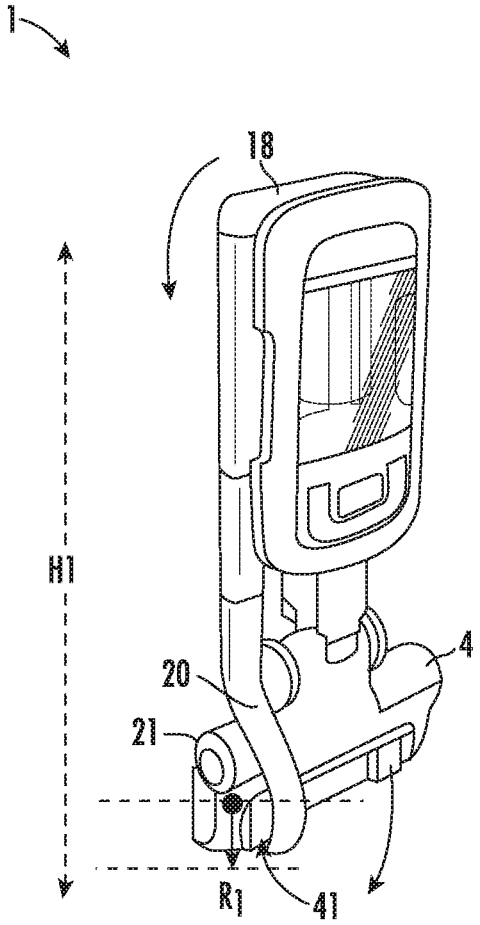

The battery housing 21 may be configured to receive and electrically couple to one or more rechargeable batteries (not shown). As discussed in greater detail below, the battery housing 21 may include at least one battery charge indicator to allow a user to visually see a current battery charge level. The battery housing 21 may be disposed in other locations and is not necessarily limited to the handle member 2, or more specifically, the distal end of the handle member 2. For example, as shown in FIG. 8, the battery housing 21 may preferably be disposed in the cleaning head 4. In this example, the battery housing 21 being in or adjacent the cleaning head 4 may simplify electrical connectivity with a charging dock, such as floor-mounted charging dock 43, and may limit the necessity of routing wires/circuitry through other portions of the surface cleaning apparatus 1. Other suitable locations include, for instance, the housing 3.

Figure 9:
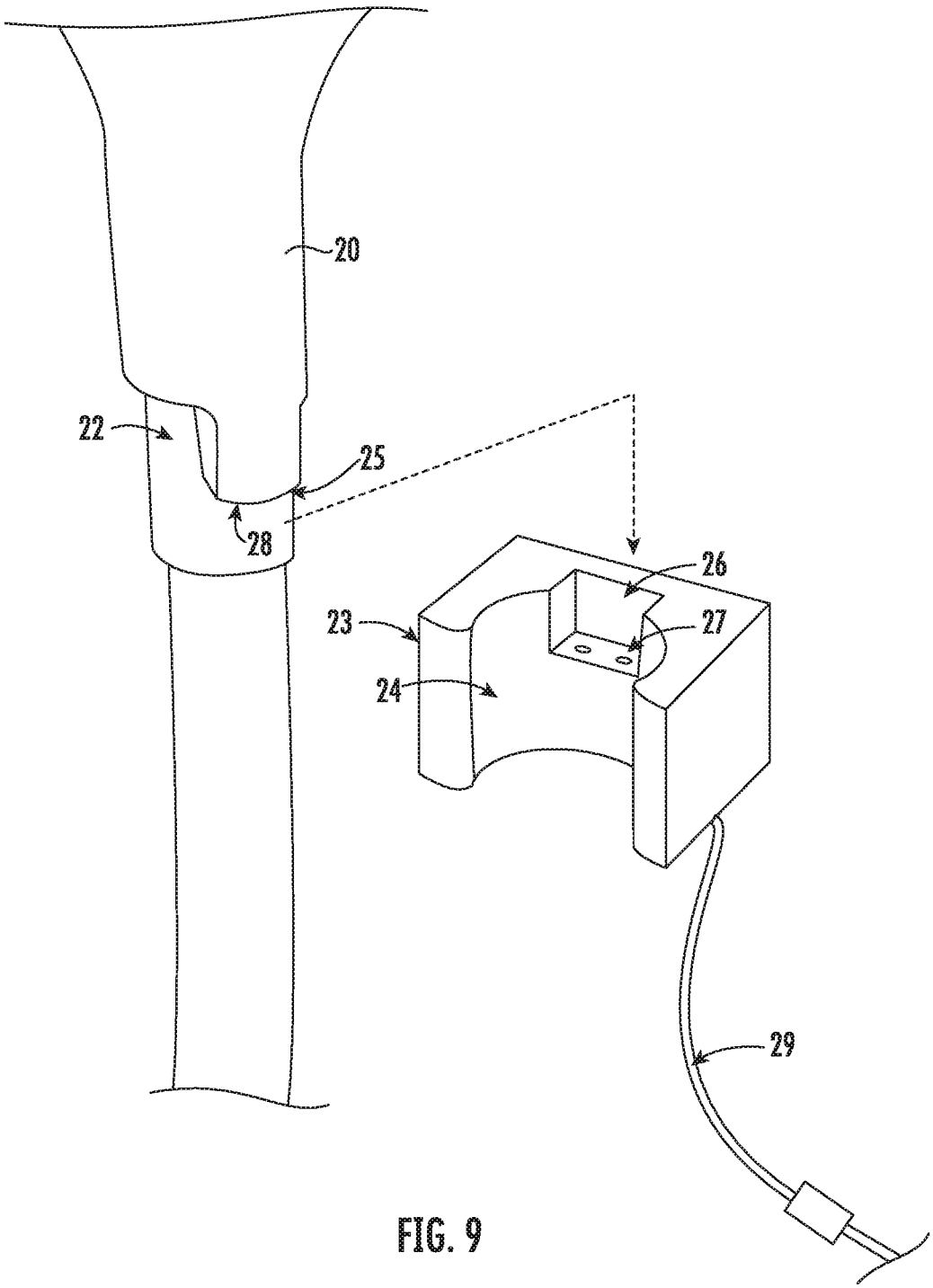
FIG. 9 shows an example wall-mounted charging dock to partially receive and couple to an example surface cleaning apparatus, in accordance with embodiments of the present disclosure.

In one embodiment, the grip portion 20 may include a mounting arrangement 22 for coupling the surface cleaning apparatus 1 to a wall, such as shown in FIG. 9. As shown in FIG. 9, the mounting arrangement 22 may include a tongue and groove arrangement to removably couple to the wall-mounted charging dock 23. The wall-mounted charging dock 23 may include an opening 24 to receive at least a portion of the handle member 2. Insertion may include aligning the tongue 25 with the groove 26 and inserting a portion of the grip portion 20 into the opening 24. As previously discussed, the wall-mounted charging dock 23 may support the surface cleaning apparatus 1 without the same resting on a floor or other support surface.

Electrical contacts 27 (or electrical interconnects 27), e.g., pins or other suitable device, may then electrically couple to an electrical contact (shown generally at 28) of the handle member. Thus the wall-mounted charging dock 23 may then deliver power from power cable 29 to charge one or more associated rechargeable batteries within the surface cleaning apparatus 1. Note that the electrical contact 28 may be disposed at other locations in the surface cleaning apparatus 1 and are not necessarily limited to the handle member 2. For instance, electrical contacts 46 (FIG. 5) may be disposed on the cleaning head 4 at a distal end to electrically couple to a floor-positioned recharging dock/station 43, as discussed further below in greater detail. The surface cleaning apparatus 1 may include electrical contacts at a plurality of positions to allow for a user to decide which charging approach is most desirable. In some instances, the surface cleaning apparatus 1 couples directly to a power outlet using an electrical cable without a charging dock.

A docking circuit (not shown) within the surface cleaning apparatus 1 may be configured to electrically couple to the charging dock 23. The docking circuit may include a plurality of components to, for instance, convert, regulate or otherwise condition power waveforms received via the charging dock 23 during battery charging operations.

As shown in FIG. 10, and in accordance with an embodiment, the grip portion 20 may include a first battery charge indicator 30. The first battery charge indicator 30 may comprise one or more light emitting diodes (LEDs) or other suitable device that allows for a current battery charge to be displayed to a user. In an embodiment, the grip portion 20 may include a second battery charge indicator, e.g., battery charge indicator 45. The second battery charge indicator 45 may be disposed opposite the first battery charge indicator 30, although the disclosure should not be limited in this regard. Battery charge indicator 45 may advantageously allow a user to view the current battery charge level even when the handle member 2 is in the storage position (see e.g., FIG. 5).

Returning to FIGS. 1-3, the handle member 2 may comprise a plurality of portions including first and second handle portions 2-1 and 2-2. The second handle portion 2-2 may be configured to at least partially receive the first handle portion 2-1. For example, and as shown, the second handle portion 2-2 may include a diameter which is larger than a corresponding diameter of the first handle portion 2-1. Thus, the first and second handle portions 2-1 and 2-2 may form a telescoping arrangement (or telescoping mechanism). The telescoping arrangement may then allow the first handle portion 2-1 to retract (or slidably move) along the longitudinal axis 10 into the second handle portion when transitioning the handle member 2 to the storage position. Likewise, the telescoping arrangement may then allow the first handle portion 2-1 to extend (or slidably move) when transitioning the handle member into the in-use position. Note, the telescoping arrangement may also allow a user to adjust the handle member 2 to a position which is most comfortable for use. Thus, the in-use position of the handle member 2 is not necessarily fully extended.

The first and second handle portions 2-1 and 2-2 may lock when in the storage and/or in-use position. A button (not shown) or other suitable mechanism may be utilized to release the lock to allow for retraction/extension of the first and second handle portions 2-1 and 2-2. In some cases, the button may cause automatic retraction of the first handle portion 2-1 into the second handle portion 2-2. In any event, the handle member 2 (and/or housing 3) may include a mechanical dampening arrangement (not shown) to slow the rate of travel as the first handle portion 2-1 retracts into the second handle portion 2-2.

Continuing on, the cleaning head 4 includes a first end 31 that extends to a second end 32 along a longitudinal axis 33. As shown, the longitudinal axis 33 is substantially parallel relative to the first cleaning head rotational axis 17, and is substantially perpendicular relative to the handle member rotational axis 16. The cleaning head 4 may permit movement along a cleaning path generally shown at 47 during cleaning operations. Thus, the longitudinal axis 33 may be substantially perpendicular relative to the cleaning path 47. A dirty air inlet 40 may be disposed opposite a top surface 48 of the cleaning head 4.

Figure 6:
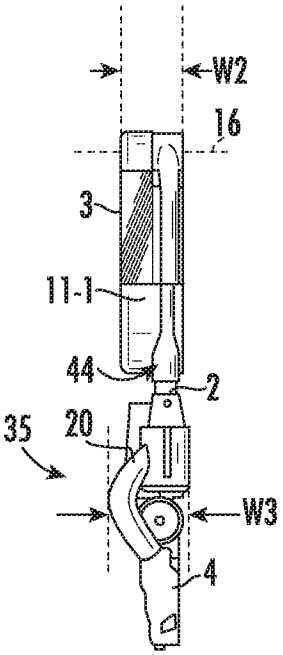
FIGS. 4-6 show perspective views of an example surface cleaning apparatus transitioning from an in-use configuration to a storage configuration, in accordance with embodiments of the present disclosure.
Figure 4:
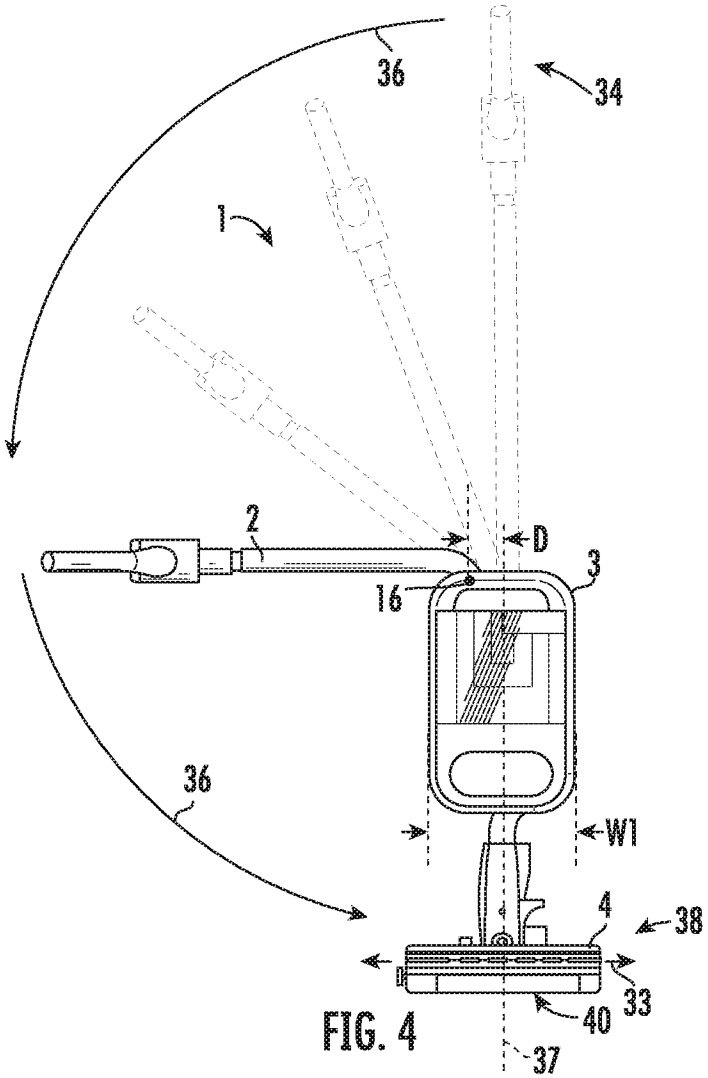

Turning to FIGS. 4-6, FIG. 6 shows a rotational path of the handle member 2 when moving the handle member 2 from an in-use position 34 to a storage position 35. As shown, the handle member 2 may rotate along path 36 to transition between the in-use position 34 and the storage position 35. The handle member rotation axis 16 may be offset from a longitudinal center line 37 by a distance D. The distance D may be about $1/4^{th}$ of the overall cross-wise width W1 of the housing 3, although other embodiments are within the scope of this disclosure. In this configuration, the cleaner head 4 may be accurately described as being in a horizontal orientation, which is to say in an in-use configuration.

In any event, the handle member 2 extends towards the cleaning head 4 and extends in parallel with the adjacent sidewall 11-1 when in the storage position 35. In some cases, the sidewall 11-1 may include a channel, such as channel 44 which is shown more clearly in FIG. 2, to receive at least a portion of the handle member 2. The channel 44 may extend the entire length of the sidewall 11-1, such as shown, or may extend along only a portion of the sidewall 11-1. The channel 44 may hold the handle member 2 based at least in part on a friction fit. However, in some embodiments the sidewall 11-1 may not include the channel 44 and the handle member 2 may simply rest against or otherwise be in close proximity to a surface defining the sidewall 11-1.

Continuing on, the cleaning head 4 may rotate relative to the housing 3 to transition from an in-use configuration 38 to a storage configuration 39. As shown, the in-use configuration 38 includes the longitudinal axis 33 substantially in parallel with a surface to be cleaned. Also, the in-use configuration 38 includes a dirty-air inlet 40 facing the surface to be cleaned. The in-use configuration 38 may therefore allow the cleaning head 4 to engage the surface to be cleaned. On the other hand, the storage configuration 39 includes the cleaner head 4 extending vertically in a co-axial relationship with the housing 3. In this configuration, the cleaner head 4 may be accurately described in a vertical orientation, which is to say in a storage position. In this orientation, the dirty-air inlet 40 faces a direction which is parallel with a surface to be cleaned.

Thus, and in accordance with an embodiment, when each of the handle member 2 and the cleaning head 4 are in their respective storage positions, the surface cleaning apparatus 1 may then be accurately described as being in a storage configuration. As shown in FIG. 6, the storage configuration allows the surface cleaning apparatus 1 to have an overall width W3, which may also be referred to as depth D3. In some embodiments, the overall width of the cleaning apparatus 1 may be equal to W2, which may also be referred to as a depth D2, although the grip portion 20 is shown as having a width W3 that exceeds W2. The grip portion 20 may be within the width W2 with minor modification.

In any event, the overall width W3 may measure about 3.5 inches or less. Likewise, the overall width W2 may measure less than W3, and may be equal to about 3.0 inches or less. However, this disclosure is not necessarily limited in this regard.

Figure 11:
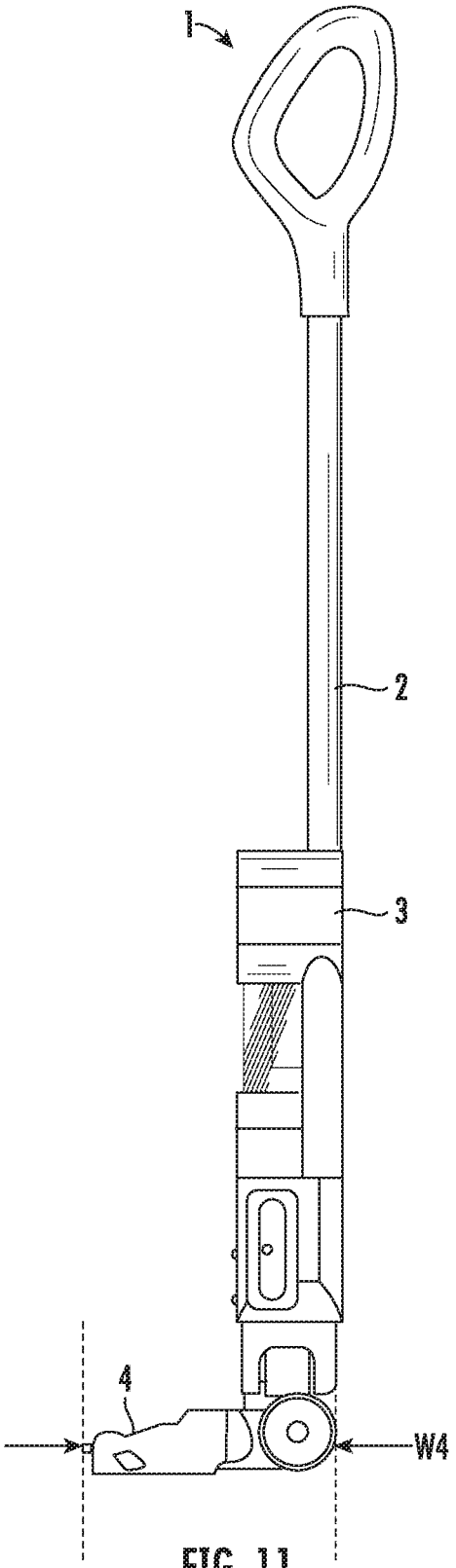
FIGS. 11-12 show additional perspective views of an example surface cleaning apparatus transitioning from an in-use configuration to a storage configuration, in accordance with embodiments of the present disclosure.
Figure 12:
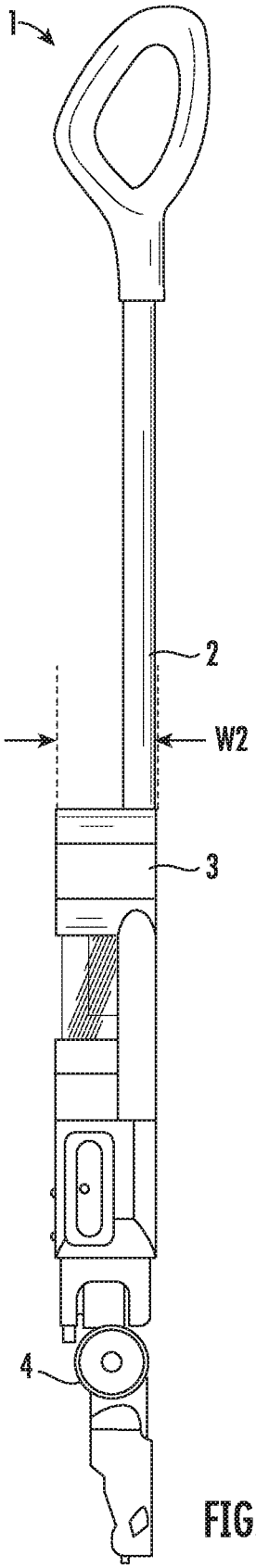

Note, the surface cleaning apparatus 1 may also be in a storage configuration when only the cleaning head 4 is in a vertical orientation, such as shown in FIGS. 11 and 12. In this embodiment, the handle member 2 being extended may allow the same to be coupled to a wall mounted charging dock, e.g., wall-mounted dock 23 shown in FIG. 9.

Figure 7:
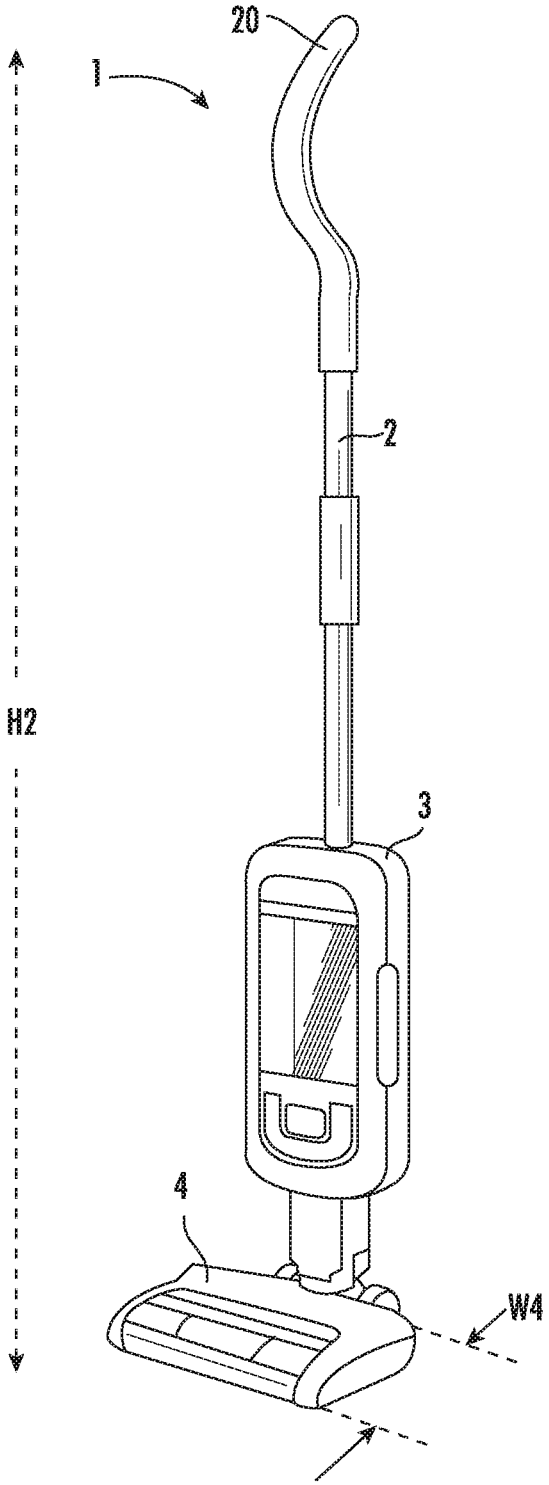
FIGS. 7-8 show additional perspective views of an example surface cleaning apparatus transitioning from an in-use configuration to a storage configuration, in accordance with embodiments of the present disclosure.

Turning to FIGS. 7 and 8, the surface cleaning apparatus 1 is shown in accordance with embodiments of the present disclosure. As previously discussed, the grip portion 20 may include a generally arcuate shape. A radius R1 of the grip portion 20 may produce an arc length equal to about or greater than half the width W4 of the cleaning head 4. Thus, the arcuate shape of the grip portion 20 may generally follow the contours of the cleaning head and may be shaped to engage one or more surfaces thereof when the cleaning head 4 is in the storage position. In some cases, a distal end of the of the grip portion 20 may extend beyond the cleaning head 4, such as shown, although other embodiments are within the scope of this disclosure. For instance, as shown in FIG. 6, the grip portion 20 may not necessarily extend beyond the cleaning head 4.

In the storage configuration, the surface cleaning apparatus 1 has an overall height of H1. The overall height H1 may measure about 18 inches although this disclosure should not be construed as limited in this regard. On the other hand, in the in-use configuration, the surface cleaning apparatus has an overall height of H2, wherein H1 is less than H2. In some cases, height H1 is about half the height H2. Thus, the ratio of H1 to H2 may about 1:2, although other ratios are within the scope of this disclosure.

In any event, and returning to FIG. 8, at least one surface of the grip portion 20, e.g., surface 41, may directly contact a surface of the cleaning head 4. To this end, the at least one surface 41 may prevent the cleaning head from moving from a storage position to an in-use position. Stated differently, the at least one surface 41 may "lock" the cleaning head 4 to substantially prevent rotational movement of the cleaning head 4 relative to the housing 3 for storage purposes.

Figures 13, 14:
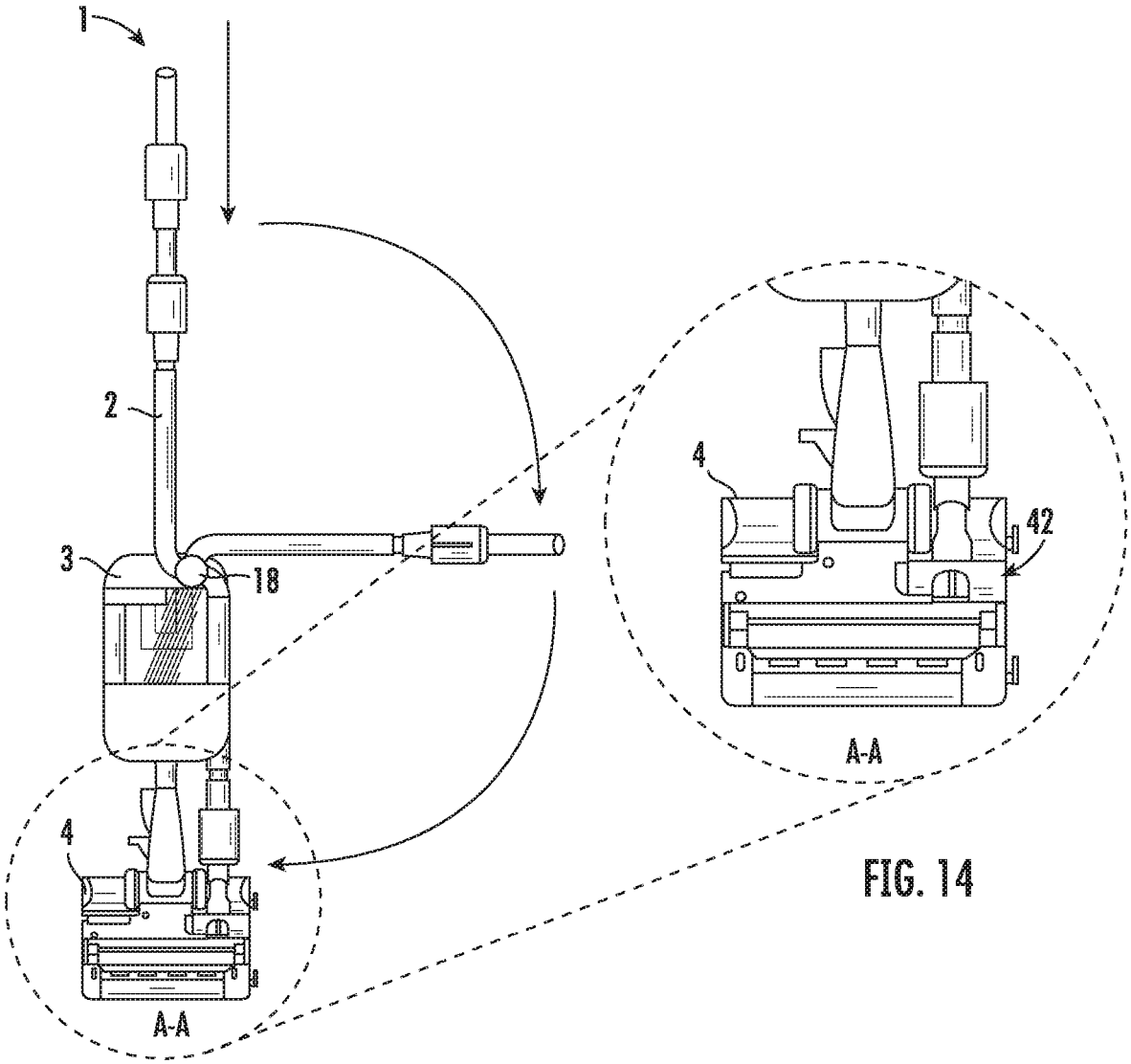
FIGS. 13-14 show additional perspective views of an example surface cleaning apparatus transitioning from an in-use configuration to a storage configuration, in accordance with embodiments of the present disclosure.

Turning to FIGS. 13 and 14, the cleaning head 4 may also be locked relative to the housing 3 based on the cleaning head 4 having a cavity to at least partially receive the handle member 2. Thus as show in the detail A-A of FIG. 14, rotational movement of the cleaning head 4 relative to the housing 3 may be prevented or otherwise limited to ensure the cleaning head 4 remains in a storage position.

Alternatively, or in addition, a mechanical locking mechanism (not shown) may engage within the housing 3 and/or the cleaning head 4 in response to the handle member 2 transitioning from an in-use position. The mechanical locking mechanism may then ensure that the rotational movement of the cleaning head 4 relative to the housing 3 is prevented or otherwise limited to prevent the cleaning head 4 from inadvertently transitioning from the storage position.

Figure 15:
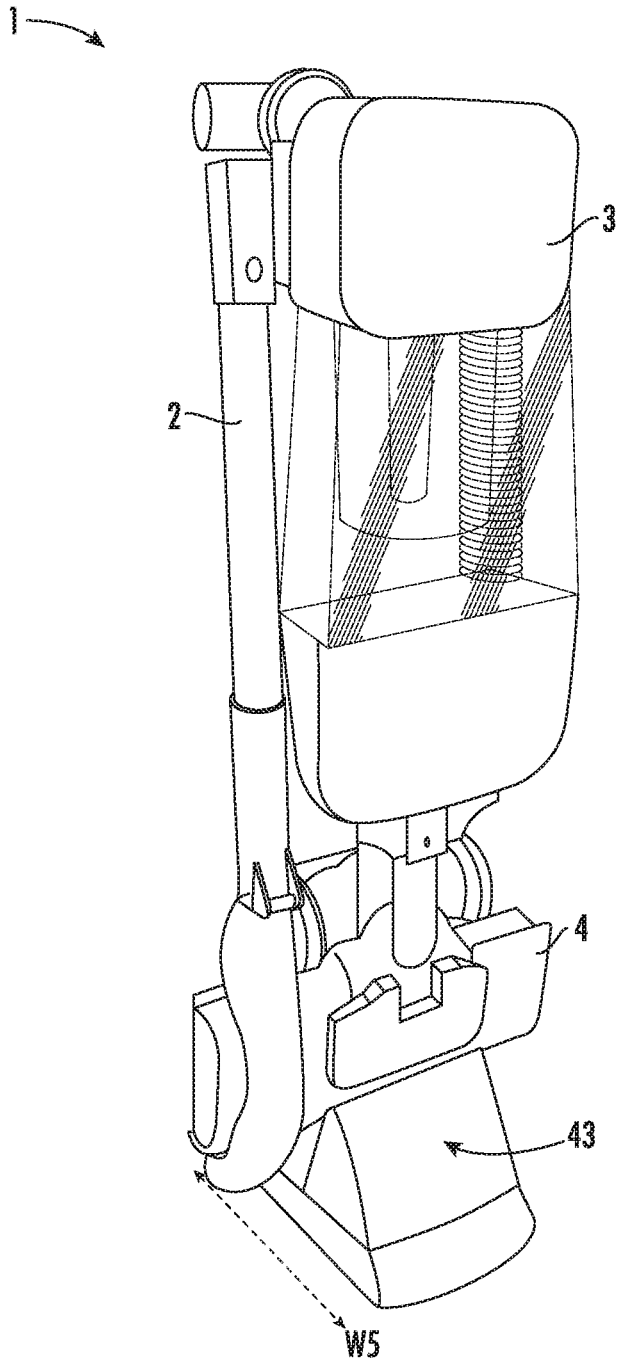
FIG. 15 shows an example surface cleaning apparatus coupled to a floor-based charging dock, in accordance with embodiments of the present disclosure.

FIG. 15 shows the surface cleaning apparatus 1 coupled into a charging dock 43 (or floor charging dock), in accordance with an embodiment. The charging dock 43 may couple to a floor or other suitable surface via one or more suction cups (as shown) or other suitable temporary coupling device. As shown, the cleaning apparatus 1 is in a storage configuration as discussed above, e.g., aligned along longitudinal axis 10, and at least a portion of the cleaning head 4 is received by a receptacle the charging dock 43. The charging dock 43 may prevent movement (rotational and/or swivel movement) of the head 4 relative to the housing of the housing 3, e.g., to ensure the surface cleaning apparatus remains upright in the charging dock 43.

In this configuration, the charging dock 43 may both physically and electrically couple to the surface cleaning apparatus 1 for recharging and storage purposes. As previously discussed, a docking circuit (not shown) within the surface cleaning apparatus 1 may be configured to electrically couple to the charging dock 43. The docking circuit may include a plurality of components to, for instance, convert, regulate or otherwise condition power waveforms received via the charging dock 43 during battery charging operations.

The profile of the charging dock 43 may include a width W5 which is substantially equal to the overall width of the cleaning apparatus 1, e.g., width W2 shown in FIG. 6, thus ensuring that the surface cleaning apparatus 1 remains relatively compact when coupled into the charging dock 43. In the shown embodiment, the charging dock 43 may extend about 5 inches from the wall, although this should not be construed as limiting the present disclosure and the charging dock may include a width which is less than or equal to the overall width W2 or width W3.

The surface cleaning apparatus 1 may be manually transitioned from a storage configuration to an in-use configuration, and vice-versa, based on a user-supplied force. Alternatively, or in addition, the surface cleaning apparatus 1 may be configured to automatically transition from an in-use configuration to a storage configuration. For instance, and with reference again to FIGS. 7 and 8, the surface cleaning apparatus 1 may include a button or other suitable device that a user may engage to transition the surface cleaning apparatus into a storage configuration. For example, the surface cleaning apparatus 1 may include a button on at least one of the handle member 2, housing 3, and/or the cleaning head 4.

Alternatively, or in addition, the surface cleaning apparatus 1 may initiate an automatic transition to the storage configuration in response to a user-supplied force which causes the handle member 2 to rotate about housing 3 along path 6 (FIG. 4) a number of degrees that exceeds a predetermined threshold. For instance, the predefined threshold may be about 5 degrees, or preferably 10 degrees, and movement of the handle member 2 in excess of that threshold may then cause a storage sequence, as discussed below, to be automatically initiated.

In any such cases, the surface cleaning apparatus may begin a storage sequence to transition to the storage mode automatically. The sequence may include, for example, retracting the handle member 2 via the telescoping arrangement discussed above. Then, the rotational member 18 may actuate/engage causing the handle member 2 to travel along the path 36, which is shown more clearly in FIG. 4. In some cases, retraction of the handle member 2 may occur while rotational movement of the handle member 2 occurs, e.g., as shown in FIG. 4. In other cases, the handle member 2 may fully-retract prior to rotational movement of the handle member 2. In either case, the surface cleaning apparatus 1 may include a dampening arrangement (not shown) to slow the rate of travel as the handle member 2 retracts and/or as the handle member 2 rotates.

The cleaning head 4 may also automatically transition to a storage position during the storage sequence. In an embodiment, the handle member 2 may become "unlocked" and allowed to rotate in response to the cleaning head 4 transitioning to the storage position. Stated differently, the transitioning of the cleaning head 4 may allow the handle member to become rotatable and thus, "unlocked" from an in-use configuration so that the handle member 2 may be rotated into the storage position. Of course, this unlocking of the handle member 2 based on the position of the cleaning head 4 is equally applicable to manual adjustments to transition the surface cleaning apparatus 1 into a storage configuration.

In some cases, the cleaning head 4 may be manually brought to the storage position in some embodiments based on the user disengaging a lock, for instance. The cleaning head 4 may transition before, during, or after the handle member 2 transitions into the storage position. Notably, the arcuate shape of the grip portion 20 may allow the cleaning head 4 to rotate without obstruction even after the handle member 2 is in the storage position, such as shown in FIG. 8.

The surface cleaning apparatus 1 may also support automatically transitioning from a storage configuration to an in-use configuration. The above-description may be performed in reverse, essentially, and is therefore equally applicable and will not be discussed again for brevity.

It should be noted that the storage/in-use sequence may be performed in a fully-automatic fashion, e.g., requiring a button press or other minimal user intervention, or in a partially-automatic fashion whereby the user performs at least part of the sequence manually. For instance, the user may cause the handle member 2 to retract via the telescope mechanism as part of the storage sequence and the user may then press a storage button to begin automatic execution of the remaining storage sequence steps as described above. Of course, the act of retracting the handle member 2 alone may be sufficient to cause the surface cleaning apparatus 1 to, in a general sense, infer the user desires the surface cleaning apparatus 1 to transition to a storage mode and may simply begin that transition without further user interaction.

Alternatively, or in addition to the surface cleaning apparatus 1 having a button or other suitable user input to allow a user to automatically transition the surface cleaning apparatus 1 from an in-use configuration to a storage configuration, and vice-versa, the surface cleaning apparatus 1 may be configured to receive an external signal/command to cause transitioning to occur. For instance a dock, such as the wall-mounted charging dock 23 and the floor charging dock 43, may provide a signal (e.g., a DC or AC waveform, a digital signal, and so on) to cause the surface cleaning apparatus 1 to transition from an in-use configuration to a storage configuration. The signal may be received by a docking circuit within the surface cleaning apparatus 1, as discussed above. A controller associated with the docking circuit may then interpret the signal and determine an action to execute, e.g., to turn off the floor cleaning apparatus 1 and initiate automatic transition of the same from an in-use configuration to a storage configuration.

Alternatively, or in addition, the surface cleaning apparatus 1 may transition from an in-use configuration to a storage configuration based on a mechanical arrangement that detects physical proximity with a charging dock. For instance, a switch or other contact may be disposed on the handle member 2, housing 3, and/or cleaning head 4 that may be used to mechanically detect physical proximity with a charging dock.

The signal may also be utilized by the docking circuit to charge one or more batteries associated with the surface cleaning apparatus 1. The surface cleaning apparatus 1 may affirmatively indicate when physical and/or electrical coupling with charging dock has occurred. For instance, the surface cleaning apparatus 1 may include one or more LEDs (e.g., visual indicator 30) that changes color or otherwise indicates successful docking. Alternatively, or in addition, the surface cleaning apparatus 1 may emit an audible beep or other sound to indicate successful docking and/or battery charging completion. Likewise, the visual indicator 30 may visualize a recharge status including, for instance, the current percent of battery charge, e.g., 0 to 100%.

In accordance with an aspect of the present disclosure a surface cleaning apparatus is disclosed. The surface cleaning apparatus including a housing having a cleaning head coupling section for coupling to the cleaning head and a handle coupling section for coupling to a handle member, a cleaning head coupled to the cleaning head coupling section, and a handle member coupled to the handle coupling section of the housing, the handle member being movable between an in-use position and a storage position, wherein the handle member rotates about the handle coupling section of the housing to transition the handle member from the in-use position to the storage position.

In accordance with another aspect of the present disclosure, a surface cleaning apparatus is disclosed. The surface cleaning apparatus including a housing having a cleaning head coupling section for coupling to the cleaning head and a handle coupling section for coupling to a handle member, a cleaning head coupled to the cleaning head coupling section, a handle member coupled to the handle coupling section of the housing, the handle member being movable between an in-use position and a storage position, wherein the handle member rotates about the handle coupling section of the housing to transition the handle member from the in-use position to the storage position, and a storage button, the storage button to receive user input, and in response thereto, automatically cause the handle member to transition from an in-use position to a storage position.

In accordance with another aspect of the present disclosure a surface cleaning apparatus is disclosed. The surface cleaning apparatus including a housing having a cleaning head coupling section for coupling to the cleaning head and a handle coupling section for coupling to a handle member, a cleaning head coupled to the cleaning head coupling section, a handle member coupled to the handle coupling section of the housing, and a battery housing to receive at least one removable battery, wherein the handle member includes at least one battery charge indicator to visually indicate a current charge level of the at least one removable battery to a user.

In accordance with another aspect of the present disclosure a surface cleaning apparatus is disclosed. The surface cleaning apparatus including a housing having a cleaning head coupling section for coupling to the cleaning head and a handle coupling section for coupling to a handle member, a cleaning head coupled to the cleaning head coupling section, the cleaning head being movable between an in-use position and a storage position, a handle member coupled to the handle coupling section of the housing, the handle member being movable between an in-use position and a storage position, wherein the handle member rotates about the handle coupling section of the housing to transition the handle member from the in-use position to the storage position, and wherein the storage position of the handle member includes the handle member extending towards the cleaning head and extending in parallel with a sidewall of the housing, and the storage position of the cleaning head includes the cleaning head in a vertical configuration whereby the cleaning head extends along an axis in parallel with the handle member.

In accordance with yet another aspect of the present disclosure a surface cleaning apparatus is disclosed. The surface cleaning apparatus including a housing having a cleaning head coupling section for coupling to the cleaning head and a handle coupling section for coupling to a handle member, a cleaning head coupled to the cleaning head coupling section, the cleaning head being movable between an in-use position and a storage position, a handle member coupled to the handle coupling section of the housing, the handle member being movable between an in-use position and a storage position, wherein the handle member rotates about the handle coupling section of the housing to transition the handle member from the in-use position to the storage position, wherein the cleaning head is prevented from movement relative the housing based at least in part on the handle member being in the storage position.

In accordance with yet another aspect of the present disclosure a surface cleaning apparatus is disclosed. The surface cleaning apparatus including a housing having a cleaning head coupling section for coupling to the cleaning head and a handle coupling section for coupling to a handle member, a cleaning head coupled to the cleaning head coupling section, the cleaning head being movable between an in-use position and a storage position, a handle member coupled to the handle coupling section of the housing, the handle member being movable between an in-use position and a storage position, wherein the handle member rotates about the handle coupling section of the housing to transition the handle member from the in-use position to the storage position, and a docking circuit to detect coupling to a charging dock and automatically transition the handle member to a storage position.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure, which is not to be limited except by the following claims.

What is claimed is:

1. A surface cleaning apparatus comprising:

a cleaning head includes a first end disposed opposite a second end along a longitudinal axis;

a handle member;

a housing;

a cleaning head coupling section rotatably coupling the cleaning head to the housing about a first cleaning head rotation axis and a second cleaning head rotation axis, the second cleaning head rotation axis being substantially perpendicular to the first cleaning head rotation axis; and a handle coupling section rotatably coupling the handle member to the housing;

wherein the handle member rotates about a handle rotation axis of a handle coupling section to transition the handle member from an in-use position to a storage position, wherein the handle rotation axis is substantially perpendicular to the longitudinal axis of the cleaning head and substantially perpendicular to the cleaning head rotation axis;

wherein the cleaning head is substantially prevented from rotation about the first and/or the second cleaning head rotation axis based at least in part on a surface of the handle member directly contacting a surface of the cleaning head.

2. The surface cleaning apparatus of claim 1, wherein the storage position of the handle member includes the handle extending toward the cleaning head and substantially in parallel with an adjacent sidewall of the housing.

3. The surface cleaning apparatus of claim 1, the second cleaning head rotation axis being at an angle of about 45 degrees relative to a longitudinal axis of the housing.

4. A surface cleaning apparatus comprising:

a cleaning head;

a handle member;

a housing;

a cleaning head coupling section coupling the cleaning head to the housing; and a handle coupling section coupling the handle member to the housing, wherein the handle member rotates about the handle coupling section to transition the handle member from an in-use position to a storage position;

wherein the handle member transitions from the in-use position to the storage position automatically.

5. The surface cleaning apparatus of claim 4, wherein the handle member transitions from the in-use position to the storage position automatically in response to a user causing the handle member to manually rotate at least partially about the handle coupling section.

6. The surface cleaning apparatus of claim 4, wherein the handle member transitions from the in-use position to the storage position automatically in response to at least a portion of the surface cleaning apparatus detecting physical and/or electrical contact with a charging dock.

7. A surface cleaning apparatus comprising:

a cleaning head;

a handle member;

a housing;

a cleaning head coupling section coupling the cleaning head to the housing; and a handle coupling section coupling the handle member to the housing, wherein the handle member rotates about the handle coupling section to transition the handle member from an in-use position to a storage position;

wherein the housing and/or handle member include a dampening mechanism to slow rotational travel of the handle member about the handle coupling section when transitioning from the in-use position to the storage position.

8. A surface cleaning apparatus comprising:

a cleaning head;

a handle member;

a housing;

a cleaning head coupling section coupling the cleaning head to the housing;

a handle coupling section coupling the handle member to the housing, wherein the handle member rotates about the handle coupling section to transition the handle member from an in-use position to a storage position; and a hand grip portion, and wherein the hand grip portion includes a battery housing to receive one or more removable batteries, wherein the battery housing of the hand grip has a cylindrical shape.

9. The surface cleaning apparatus of claim 8, wherein the battery housing of the hand grip portion includes a first battery charge indicator and a second battery charge indicator disposed opposite the first battery charge indicator.

10. A surface cleaning apparatus comprising:

a housing having a cleaning head coupling section and a handle coupling section;

a cleaning head coupled to the cleaning head coupling section;

a handle member coupled to the handle coupling section, the handle member being movable between an in-use position and a storage position, wherein the handle member rotates about the handle coupling section of the housing to transition the handle member from the in-use position to the storage position; and a storage button, the storage button to receive user input, and in response thereto, automatically cause the handle member to transition from the in-use position to the storage position.

11. The surface cleaning apparatus of claim 10, wherein the storage button is disposed on the handle member or the housing.

12. The surface cleaning apparatus of claim 10, further comprising at least one removable battery, and a docking circuit configured to electrically couple to a docking unit to charge the at least one removable battery.

13. The surface cleaning apparatus of claim 12, wherein the docking circuit includes electrical contacts to electrically couple to the docking unit, the electrical contacts being disposed on the handle member, the cleaning head, or the housing.

14. The surface cleaning apparatus of claim 13, wherein the electrical contacts are disposed adjacent a handle portion of the handle member.

15. The surface cleaning apparatus of claim 10, wherein the cleaning head automatically transitions from a horizontal configuration to engage a surface to be cleaned when the handle member is in the in-use position, and wherein the cleaning head automatically transitions to a vertical configuration when the handle member is in the storage position.

* * * * *